US010399756B2

(12) United States Patent
Truhitte

(10) Patent No.: US 10,399,756 B2
(45) **Date of Patent: *Sep. 3, 2019**

(54) CARRIER TAPE WITH STANDOFF UNITS

(71) Applicant: SEMICONDUCTOR COMPONENTS INDUSTRIES, LLC, Phoenix, AZ (US)

(72) Inventor: Darrell D. Truhitte, Phoenix, AZ (US)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/126,614

(22) Filed: Sep. 10, 2018

(65) Prior Publication Data

US 2019/0002173 A1 Jan. 3, 2019

Related U.S. Application Data

(63) Continuation of application No. 15/158,424, filed on May 18, 2016, now Pat. No. 10,093,468.

(51) Int. Cl.
*B65D 73/02* (2006.01)

(52) U.S. Cl.
CPC ..... *B65D 73/02* (2013.01)

(58) Field of Classification Search
CPC . B65D 73/02; B65D 75/327; H01L 21/67333; H01L 2221/68313; H05K 13/0084
USPC ..... 206/714, 713
See application file for complete search history.

(56) References Cited

U.S. PATENT DOCUMENTS

| | | | | |
|---|---|---|---|---|
| 5,765,692 | A * | 6/1998 | Schenz | B65D 73/02 206/713 |
| 6,105,783 | A | 8/2000 | Sato | |
| 7,021,467 | B2 | 4/2006 | Agari | |
| 7,127,805 | B2 | 10/2006 | Watson | |
| 7,654,392 | B2 | 2/2010 | Agari | |
| 2002/0005371 | A1 | 1/2002 | Susaki | |
| 2007/0074996 | A1 * | 4/2007 | Nice | H05K 13/0084 206/714 |
| 2012/0037538 | A1 | 2/2012 | Tokoi et al. | |
| 2015/0114695 | A1 | 4/2015 | Shimizu et al. | |

* cited by examiner

*Primary Examiner* — Chun Hoi Cheung
(74) *Attorney, Agent, or Firm* — Adam R. Stephenson, Ltd.

(57) ABSTRACT

A carrier tape system, in some embodiments, comprises: a tape; a series of index holes along a length of said tape; a series of pockets along said length; a first series of standoff units along said length; and a second series of standoff units along said length, wherein the series of pockets is positioned between the first series of standoff units and the second series of standoff units, wherein the standoff units create a clearance space between the bottom surfaces of said pockets and the tape when said tape is wound on a reel.

20 Claims, 2 Drawing Sheets

CARRIER TAPE WITH STANDOFF UNITS

CROSS REFERENCE TO RELATED APPLICATIONS

This application is a continuation application of the earlier U.S. Utility Patent Application to Truhitte entitled "Carrier tape with Standoff Units," application Ser. No. 15/158,424, filed May 18, 2016, now pending, the disclosure of which is hereby incorporated entirely herein by reference.

BACKGROUND

Background

Carrier tape is typically used to store large numbers of electronic devices—such as electronic chips and other circuit components—in a convenient and space-conserving manner. The electronic devices are stored in numerous pockets that are arranged in a serial fashion along the length of the tape. The pockets are usually sealed using cover tape to prevent damage to or loss of the electronic devices while the devices are stored in the pockets. Once loaded with electronic devices and sealed with cover tape, the carrier tape is wound around a reel for storage or transport.

SUMMARY

At least some of the embodiments disclosed herein are directed to a carrier tape system, comprising: a tape; a series of index holes along a length of said tape; a series of pockets along said length; a first series of standoff units along said length; and a second series of standoff units along said length, wherein the series of pockets is positioned between the first series of standoff units and the second series of standoff units, wherein the standoff units create a clearance space between the bottom surfaces of said pockets and the tape when said tape is wound on a reel. At least some of these embodiments may be supplemented using one or more of the following concepts, in any order and in any combination: further comprising a cover tape adhered to the tape between the first and second series of standoff units, said clearance space existing between at least some of said bottom surfaces and at least some of the cover tape; wherein the series of index holes is positioned between the first series of standoff units and a first edge along the length of the tape, the first series of standoff units is positioned between the series of pockets and the series of index holes, and the second series of standoff units is positioned between the series of pockets and a second edge along the length of the tape; wherein the depths of the standoff units create said clearance space; wherein the widths of the standoff units create said clearance space; wherein spacing between the series of standoff units and the series of pockets create the clearance space; wherein the spacing between each of the standoff units in each of the series of standoff units creates said clearance space; wherein the first and second series of standoff units are arranged in a staggered pattern in relation to each other; wherein at least two standoff units on opposing sides of the series of pockets are aligned with each other; wherein the standoff units are hollow; wherein the standoff units are filled; wherein the pockets in the series have a pitch between 1 mm and 2 mm, inclusive.

At least some embodiments are directed to a method for manufacturing a carrier tape with standoff units, comprising: producing a series of index holes along a length of a tape; producing a series of pockets along said length; and producing a first series of standoff units and a second series of standoff units along said length, wherein the series of pockets is between the first and second series of standoff units. At least some such embodiments may be supplemented using one or more of the following concepts, in any order and in any combination: further comprising producing the first and second series of standoff units to have depths such that a clearance space exists between the bottom surfaces of the pockets and the tape when said tape is wound on a reel; further comprising producing the first and second series of standoff units to have widths such that a clearance space exists between the bottom surfaces of the pockets and the tape when said tape is wound on a reel; further comprising spacing the series of standoff units and the series of pockets such that a clearance space exists between the bottom surfaces of the pockets and the tape when said tape is wound on a reel.

At least some embodiments are directed to a method for using a carrier tape with standoff units, comprising: obtaining a carrier tape having a series of pockets along a length of the carrier tape and a first and second series of standoff units along said length, the series of pockets positioned between said first and second series; populating at least one of the pockets with an electronic device; sealing a cover tape over the series of pockets; and winding said carrier tape on a reel. At least some such embodiments may be supplemented using one or more of the following concepts, in any order and in any combination: further comprising the standoff units preventing contact between the bottom surfaces of said pockets and the cover tape after said winding is complete; further comprising sealing said cover tape to the carrier tape between the series of pockets and the first series of standoff units and between the series of pockets and the second series of standoff units; wherein said pockets have a 1 mm pitch.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

Disclosed herein are methods and systems pertaining to a carrier tape having standoff units that prevent electronic devices populating carrier tape pockets from adhering to cover tape used to seal the pockets. In particular, two series of standoff units extend along the length of the carrier tape, and a series of pockets extends along the length of the carrier tape in between the two series of standoff units. The standoff units have a particular depth, width, and spacing relative to the pockets and/or each other to ensure that when the carrier tape is wound on a reel, the standoff units create a clearance space between the pockets and the cover tape positioned on the layer of carrier tape below the pockets. Thus, the bottom surfaces of the pockets do not contact the cover tape positioned below the pockets. By preventing such contact, the bottom surfaces of the pockets do not apply pressure to the cover tape; thus, the cover tape is less likely to adhere to the electronic devices that they cover. As a result, when the tape is unwound and the cover tape is removed, the electronic devices remain in the pockets.

Figure 1A:
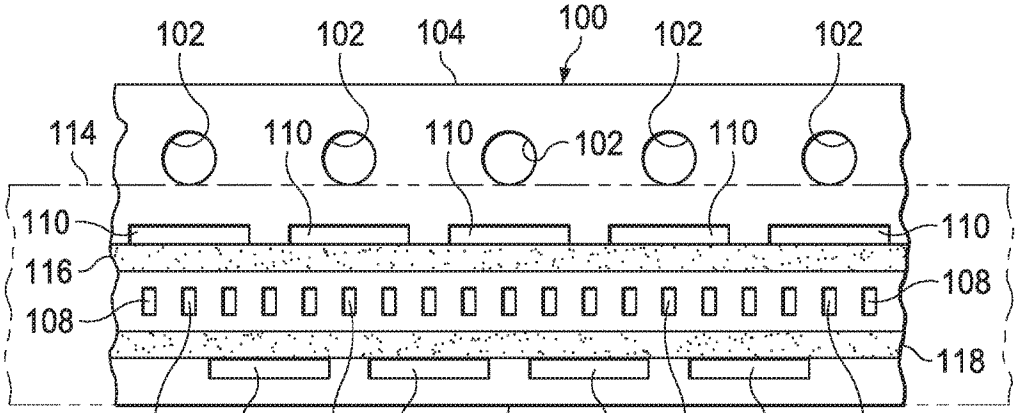
FIG. 1A is a top-down view of a carrier tape with standoff units.

FIG. 1A is a top-down view of a carrier tape 100. The carrier tape 100 includes a series of index holes 102 along the length of the tape; opposing, length-wise edges 104 and 106; a series of pockets 108 along the length of the tape; a series of standoff units 110 along the length of the tape; and a series of standoff units 112 along the length of the tape. FIG. 1A further illustrates a cover tape 114 (indicated by dash marks) that is sealed to the carrier tape 100 along length-wise lines 116 and 118.

The carrier tape 100 is composed of any suitable material, such as polycarbonates and polystyrenes. Other materials also may be used. The length of the carrier tape 100 is variable depending on the number of electronic devices that are to be carried. The width of the carrier tape 100 between opposing edges 104 and 106 also may vary, but, in at least some embodiments, it is between 8 millimeters and 24 millimeters, inclusive.

The index holes 102 are used by appropriate systems—for instance, manufacturing and/or assembly systems—to handle the carrier tape 100. For example, such systems may contain protrusions that mate with the index holes 102 to grip and move the carrier tape 100 while the pockets 108 are populated with electronic devices. In some embodiments, the index holes 102 are circular and have a diameter of 1.5 millimeters, although the scope of disclosure encompasses index holes of any suitable size and shape. In some embodiments, the index holes 102 have a pitch of 4 millimeters, but other pitches are contemplated. In some embodiments, the index holes 102 are centered approximately (i.e., within 15% of) 1.85 millimeters from the edge 104.

As explained above, the pockets 108 house any suitable type of electronic device (e.g., chips, circuit components). In some cases, all pockets 108 are populated with such electronic devices, while in other cases, some or even only one of the pockets 108 may be populated with electronic devices. The pockets 108 extend below the plane of the carrier tape—for example, in the top-down view of FIG. 1A, the bottom surfaces of the pockets 108 are farther away than the rest of the carrier tape 100. Each pocket 108 is sized in terms of width, length and depth as desired. In at least some embodiments, the pockets 108 are approximately 0.25 millimeters wide, 0.75 millimeters long, and 0.50 millimeters deep. The scope of disclosure, however, is not limited to these or any other particular dimensions. Further, although the pockets 108 are shown as being rectangular in shape in the top-down view of FIG. 1A, embodiments are not limited to any particular shape. The pitch of the pockets 108 can be determined as desired, but, in at least some embodiments, it is between approximately 1 and 2 millimeters, inclusive. The pockets 108 in the series shown in FIG. 1A may all be sized and shaped similarly, but, in other embodiments, different pockets 108 may have different shapes, sizes and pitches between them.

Figure 1B:
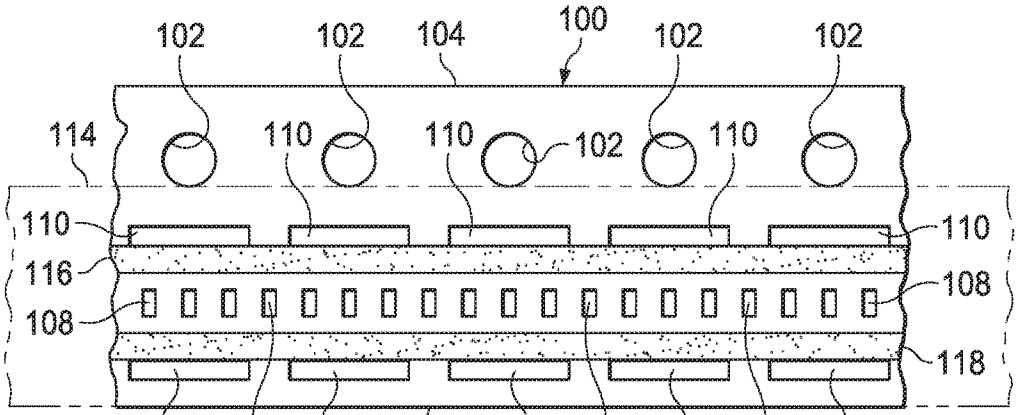
FIG. 1B is a top-down view of another carrier tape with standoff units.

The series of pockets 108 is positioned between the series of standoff units 110 and 112. One purpose of the standoff units 110 and 112 is to ensure that the bottom surfaces of the pockets 108 do not touch—and, thus, do not apply pressure to—any other part of the carrier tape 100 or to the cover tape 114 when the carrier tape 100 is wound on a reel. This function of the standoff units 110, 112 will be described in greater detail below in the context of FIGS. 1D-1E. Referring still to the top-down view of FIG. 1A, the standoff units 110, 112 preferably are rectangular in shape, although the scope of disclosure is not limited to any specific shape. For instance, the standoff units 110, 112 may be oval-shaped or may have different shapes. In some embodiments, the standoff units 110, 112 extend below the plane of the carrier tape 100, similar to the pockets 108. In other embodiments, the standoff units 110, 112 rise above the plane of the carrier tape 100—for instance, in the top-down view of FIG. 1A, the top surfaces of the standoff units 110, 112 may be closer than the rest of the carrier tape 100. Further, the standoff units 110, 112 are sized in terms of length, width and depth as desired. In at least some embodiments, each standoff unit 110, 112 is approximately 3 millimeters long, 0.50 millimeters wide, and 1 millimeter deep. The standoff units 110 may be spaced approximately 4 millimeters apart, and the standoff units 112 also may be spaced approximately 4 millimeters apart, although other pitches are contemplated. The series of standoff units 110, in some embodiments, is spaced approximately 3.4 millimeters from the series of standoff units 112, but this parameter, like all design specifications provided in this disclosure, may vary. The series of standoff units 110, in some embodiments, is spaced 1.85 millimeters from the series of index holes 102. In some embodiments, the series of standoff units 112 is spaced approximately 1 millimeter from the edge 106. In some embodiments, the standoff units 110, 112 are staggered with respect to each other, as shown in FIG. 1A. In other embodiments, the standoff units 110, 112 are aligned with each other, as shown in FIG. 1B. The term "series of standoff units" includes a single, continuous standoff unit that extends at least 25 millimeters in length—for example, as shown in FIG. 1C. In some embodiments, the standoff units 110, 112 are hollow, and, in other embodiments, they are filled (e.g., with the same material used to manufacture the carrier tape 100 or a different, suitable material).

The cover tape 114 is composed of any suitable material, such as and without limitation, polyester or polyethylene terephthalate. The cover tape 114 may be conductive, non-conductive or static dissipative tape and may include adhesive that is heat- or pressure-activated. One function of the cover tape 114 is to cover and protect the electronic devices populating the pockets 108 from dust, debris, liquids, electrical damage and/or mechanical impact. The size of the cover tape 114 relative to the rest of the carrier tape 100 may be as indicated by the dashed line in FIG. 1A—in some embodiments, 5.40 millimeters wide. The cover tape 114 adheres to the carrier tape 100 along lines 116 and 118. In some embodiments, each of lines 116 and 118 is 0.70 millimeters wide. In some embodiments, the line 116 is spaced from the edge 104 by 4.30 millimeters, and the line 118 is spaced from the edge 106 by 1.60 millimeters. The cover tape 114 adheres to the carrier tape 100 using any suitable adhesive material.

Figure 1D:
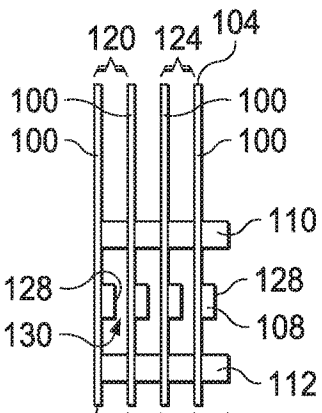
FIG. 1D is an end view of a carrier tape with standoff units.

FIG. 1D is an end view of a portion of the carrier tape 100 when the tape is wound on a reel. Four layers 120, 122, 124 and 126 of a single wound carrier tape 100 are shown. The view shown in FIG. 1D is partial, meaning that the reel and the remaining portions of the carrier tape 100 are not expressly depicted.

As illustrated, each of the layers of the carrier tape 100 has a series of pockets 108 extending below the plane of the carrier tape 100, a series of standoff units 110 extending below the plane of the carrier tape 100, and a series of standoff units 112 extending below the plane of the carrier tape 100. In preferred embodiments, the standoff units 110, 112 of each layer of tape are shaped, sized, and/or spaced from each other and/or from the pockets 108 of that layer such that adjacent pockets 108 (and, more specifically, the bottom surfaces 128 of the pockets 108) of that layer do not touch—and, thus, do not apply pressure to—the layer of carrier tape and cover tape below that layer (i.e., closer to the reel). Thus, for example, the standoff units 110, 112 of the layer 120 are shaped, sized, and spaced from each other and/or from the pockets 108 so that the bottom surfaces 128 of the pockets in the layer 120 do not make contact with the layer 122 (or the cover tape adhering to the layer 122) when the carrier tape 100 is wound on a reel. Clearance space 130 represents this lack of contact. Because contact with the cover tape of layer 122 is precluded, the cover tape of layer 122 is not forced to make contact with the electronic devices in the pockets of layer 122, and so the electronic devices in those pockets do not adhere to the cover tape.

Any suitable degree of clearance space 130 is appropriate as long as contact between the pockets and underlying cover tape is precluded. As mentioned, the clearance space 130 may be achieved by manufacturing the standoff units 110, 112 with appropriate shapes, sizes and/or spacing from each other and/or from the pockets 108. For instance, the spacing units 110, 112 in layer 120 may be spaced closely enough to each other to prevent bowing of the portion of the carrier tape 100 therebetween. If the portion of carrier tape 100 between the spacing units 110, 112 does not bow, the bottom surfaces 128 of the pockets 108 do not make contact with or apply pressure to the cover tape on the carrier tape of layer 122. Such bowing may also be prevented by fabricating the standoff units 110, 112 to be sufficiently wide. Such bowing also may be prevented by fabricating the standoff units 110, 112 to be sufficiently deep. Similarly, bowing may be prevented by manufacturing the series of standoff units 110 to be in a staggered pattern with respect to the series of standoff units 112, as shown in FIG. 1A. (In some embodiments, a non-staggered pattern may be used such that each standoff unit 110 is aligned with a corresponding standoff unit 112, as shown in FIG. 1B.) Generally, one or more of the foregoing techniques may be employed to prevent contact between pockets and underlying cover tape, taking into account various factors to determine the precise specifications necessary in a particular application, such as the rigidity of the material used to fabricate the carrier tape 100, the depths of the pockets 108, the curvature to be introduced to the carrier tape 100 when wound on a reel, cost limitations, and the like.

Figure 1E:
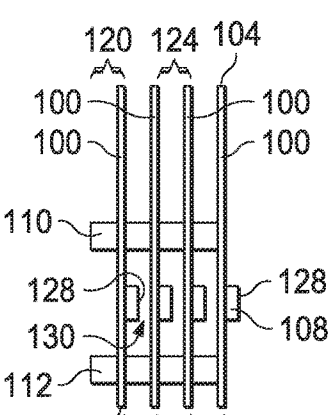
FIG. 1E is an end view of another carrier tape with standoff units.
Figure 1C:
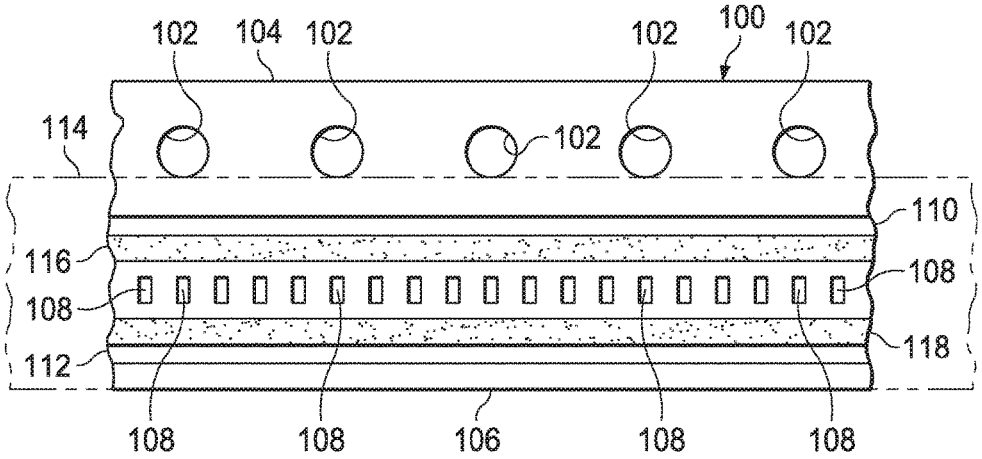
FIG. 1C is a top-down view of a different carrier tape with standoff units.

FIG. 1E shows an alternative embodiment to that of FIG. 1D. In FIG. 1E, the standoff units 110, 112 extend above the plane of the carrier tape 100. Thus, for instance, in layer 120, the standoff units 110, 112 extend in the opposite direction as the pockets 108, whereas in FIG. 1D, the standoff units 110, 112 and pockets 108 all extend in the same direction. In FIG. 1E, the overall function of the standoff units 110, 112 remains the same as in FIG. 1D—to preclude contact between the bottom surfaces of the pockets 108 and the cover tape of another layer of the carrier tape 100. However, in FIG. 1D, the standoff units prevent pockets of the same layer from contacting or applying pressure to the cover tape of a lower layer (i.e., closer to the reel); in contrast, in FIG. 1E, the standoff units protect cover tape of the same layer from being contacted or pressured by the pockets of a higher layer (i.e., farther from the reel). The sizes, shapes, spacing between the standoff units, and/or the spacing between the standoff units and the pockets are determined so that the portion of carrier tape between the standoff units does not bow and cause contact or pressure between the pockets of that higher layer and the cover tape of the lower layer. For example, referring to FIG. 1E, the specifications of the standoff units and their spacing relative to each other and relative to the pockets is such that the carrier tape of layer 120 does not bow, and thus precludes contact between the bottom surfaces 128 of the pockets on layer 120 and the cover tape on layer 122. The clearance space 130 is maintained.

Figure 2:
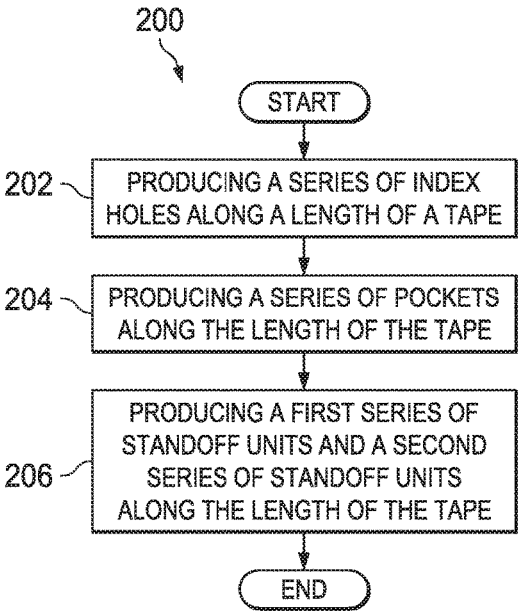
FIG. 2 is a flow diagram of a method for manufacturing a carrier tape with standoff units.

FIG. 2 is a flow diagram of a method 200 for manufacturing the carrier tape 100. The method 200 includes producing a series of index holes along a length of tape (step 202). The index holes 102 illustrated in FIG. 1A and described above are representative of this step. Any suitable method for creating the holes may be used. For example, a tool and die punch may be used to excise the index holes in the tape. Optionally, pocket holes—which are formed in the areas of the tape that will subsequently be used to create pockets, and which are used to apply vacuum suction during the cover taping process to ensure that the electronic components remain in the pockets—may also be excised from the tape during step 202. The method 200 also includes producing a series of pockets along the length of the tape (step 204). The pockets 108 illustrated in FIGS. 1A-1E and described above are representative of this step. The pockets may be created using any suitable technique. For instance, the tape may be heated until it becomes pliable, at which time it is passed through hard tooling that includes a cavity having the shape of the pocket to be formed. The tooling contains a vacuum system to pull the pliable tape into the cavity. This causes the tape to take the shape of the cavity. If pocket holes were excised during step 202, the pockets are formed over those holes during step 204. An alternative technique for creating pockets includes heating the tape until it is pliable and then passing it through a hard tooling system that contains opposing parts—a cavity shaped like a pocket, and a component that pushes the pliable tape into the cavity shaped like a pocket. Pushing the pliable tape into the cavity causes the tape to take the form of the cavity. The method 200 additionally includes producing the multiple series of standoff units along the length of the tape (step 206). The series of standoff units 110, 112 shown in FIGS. 1A-1E and described above are representative of this step. The standoff units may be created, for instance, using either of the techniques described above for creation of the pockets in step 204 if the standoff units are hollow. If the standoff units are solid or filled, they may be creating during the extrusion of the tape itself, prior to step 202. The steps of the method 200 may be performed in any suitable order. For example and without limitation, pocket holes may be created before or after pockets are formed. In addition, the method 200 may be modified as desired—for instance, by adding, deleting or modifying one or more steps.

Figure 3:
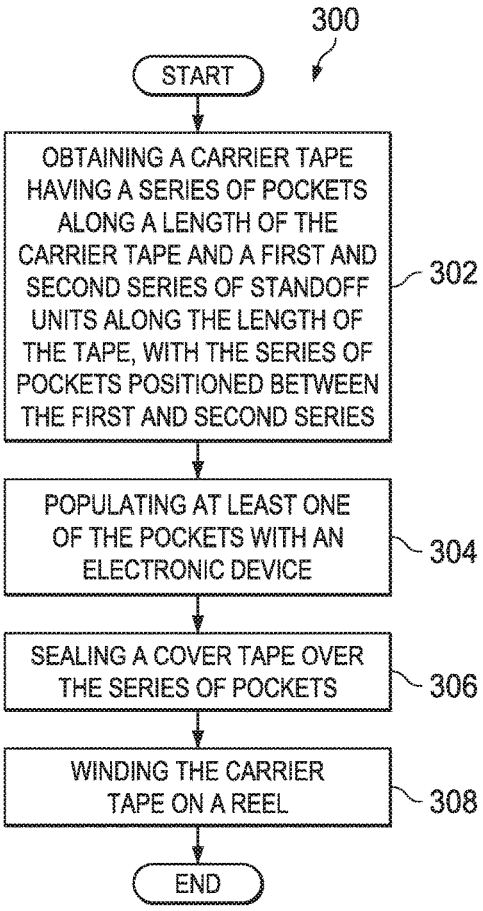
FIG. 3 is a flow diagram of a method for using a carrier tape with standoff units.

FIG. 3 is a flow diagram of a method 300 for using the carrier tape 100. The method 300 begins by obtaining a carrier tape having a series of pockets along a length of the tape and a first and second series of standoff units along the length of the tape (step 302). The series of pockets is positioned between the first and second series of standoff units (step 302). The method 300 then includes populating at least one of the pockets with an electronic device (step 304). Next, a cover tape is sealed to the carrier tape—specifically, the cover tape is sealed over the series of pockets (step 306). Finally, the method 300 comprises winding the carrier tape on a reel (step 308). When the carrier tape is wound on a reel, the standoff units desirably preclude contact between the pockets and the cover tape, as explained in detail above. The method 300 may be modified as desired—for example, by adding, deleting or modifying one or more steps.

Numerous other variations and modifications will become apparent to those skilled in the art once the above disclosure is fully appreciated. It is intended that the following claims be interpreted to embrace all such variations, modifications and equivalents.

What is claimed:

1. A carrier tape system, comprising:

a tape;

a series of index holes along a length of the tape;

a series of pockets along the length;

a first series of standoff units along the length; and a second series of standoff units along the length;

wherein the series of pockets is positioned between the first series of standoff units and the second series of standoff units;

wherein the series of pockets extends from a plane of the tape in a first direction and the first series of standoff units and the second series of standoff units each extend from the plane of the tape in a second direction opposite to the first direction;

wherein the standoff units create a clearance space between the bottom surfaces of the pockets and the tape when the tape is wound on a reel; and wherein the standoff units span a distance that is longer than at least two of the pockets.

2. The system of claim 1, further comprising a cover tape adhered to the tape between the first and second series of standoff units, the clearance space existing between at least some of the bottom surfaces and at least some of the cover tape.

3. The system of claim 1, wherein the series of index holes is positioned between the first series of standoff units and a first edge along the length of the tape, the first series of standoff units is positioned between the series of pockets and the series of index holes, and the second series of standoff units is positioned between the series of pockets and a second edge along the length of the tape.

4. The system of claim 1, wherein a depth of the standoff units creates the clearance space.

5. The system of claim 1, wherein a width of the standoff units creates the clearance space.

6. The system of claim 1, wherein spacing between the series of standoff units and the series of pockets creates the clearance space.

7. The system of claim 1, wherein a spacing between each of the standoff units in each of the series of standoff units creates the clearance space.

8. The system of claim 1, wherein the first and second series of standoff units are arranged in a staggered pattern in relation to each other.

9. The system of claim 1, wherein at least two standoff units on opposing sides of the series of pockets are aligned with each other.

10. The system of claim 1, wherein the standoff units are hollow.

11. The system of claim 1, wherein the standoff units are filled.

12. The system of claim 1, wherein the pockets in the series have a pitch between 1 mm and 2 mm.

13. A method for manufacturing a carrier tape with standoff units, comprising:

producing a series of index holes along a length of a tape;

producing a series of pockets along the length of the tape; and producing a first series of standoff units and a second series of standoff units along the length;

wherein the series of pockets is between the first and second series of standoff units;

wherein the series of pockets extend from a plane of the tape in a first direction and the first series of standoff units and the second series of standoff units each extend from a plane of the tape in a second direction opposite to the first direction; and wherein the standoff units span a distance that is longer than at least two of the pockets.

14. The method of claim 13, further comprising producing the first series and the second series of standoff units to have depths such that a clearance space exists between the bottom surfaces of the pockets and the tape when the tape is wound on a reel.

15. The method of claim 13, further comprising producing the first and second series of standoff units to have widths such that a clearance space exists between the bottom surfaces of the pockets and the tape when the tape is wound on a reel.

16. The method of claim 13, further comprising spacing the series of standoff units and the series of pockets such that a clearance space exists between the bottom surfaces of the pockets and the tape when the tape is wound on a reel.

17. A method for using a carrier tape with standoff units, comprising:

obtaining a carrier tape having a series of pockets along a length of the carrier tape and a first and a second series of standoff units along the length, the series of pockets positioned between the first and the second series of standoff units;

populating at least one of the pockets with an electronic device;

sealing a cover tape over the series of pockets; and winding the carrier tape on a reel;

wherein the series of pockets extend from a plane of the tape in a first direction and the first series of standoff units and the second series of standoff units each extend from the plane of the tape in a second direction opposite to the first direction; and wherein the standoff units span a distance that is longer than at least two of the pockets.

18. The method of claim 17, further comprising the standoff units preventing contact between the bottom surfaces of the pockets and the cover tape after the winding is complete.

19. The method of claim 17, further comprising sealing the cover tape to the carrier tape between the series of pockets and the first series of standoff units and between the series of pockets and the second series of standoff units.

20. The method of claim 17, wherein the series of pockets has a 1 mm pitch.

* * * * *